US006484320B1

(12) United States Patent
Grady

(10) Patent No.: US 6,484,320 B1
(45) Date of Patent: Nov. 26, 2002

(54) WADING DEVICE

(76) Inventor: Michael John Grady, 10935 Gadsten Way, Rancho Cordova, CA (US) 95670

( * ) Notice: Subject to any disclaimer, the term of this patent is extended or adjusted under 35 U.S.C. 154(b) by 0 days.

(21) Appl. No.: 09/942,821

(22) Filed: Aug. 29, 2001

(51) Int. Cl.[7] ..... A41D 17/02
(52) U.S. Cl. ..... 2/82; 2/242; 36/2 R
(58) Field of Search ..... 2/82, 16, 22, 24, 2/46, 62, 242, 79, 227, 23; 36/1.5, 2 R

(56) References Cited

U.S. PATENT DOCUMENTS 5,067,260 A * 11/1991 Jenkins, Jr. ..... 36/7.1 R
5,815,948 A * 10/1998 Dzielak ..... 2/22
5,896,676 A * 4/1999 Barousse ..... 36/2 R
6,094,745 A * 8/2000 Fulton ..... 2/242

* cited by examiner

*Primary Examiner*—Gloria M. Hale
*Assistant Examiner*—Tejash Patel
(74) *Attorney, Agent, or Firm*—Risto A. Rinne, Jr.

(57) ABSTRACT

An apparatus for lessening the force exerted by the current as water flows past the legs of a user who is standing perpendicular with respect to the current. A V-shaped portion is disposed upstream and, preferably, a second V-shaped portion is disposed downstream over the lower portion of each of the legs. A detachable rigid strap-on version is described along with a flexible permanently attached version that is attached to each leg of a pair of waders.

8 Claims, 2 Drawing Sheets

WADING DEVICE

BACKGROUND OF THE INVENTION

1. Field of the Invention

The present invention, in general relates to fishing and, more particularly, to waders and other devices that lessen the force of current upon the legs.

It is common for fisherman who fish rivers to walk across the river sideways, with one leg upstream and one downstream. They may stop in an area for a time and cast and wait or cast and retrieve their fishing line, depending upon the technique that is being employed.

While fishing the current presses upon the side of their legs. Sometimes, the force that is exerted by the current is substantial. This is tiring.

The current also makes noise as it flows around the legs of the user. The noise made by the current is new, it did not exist before the fisherman ventured into the flowing waters. The new sounds may scare away the fish or cause them not to feed or to feed with caution.

Accordingly, there exists today a need for a wading device that lessens the force exerted upon the legs of the user and which also decreases the noise produced. Such a device would find applicability wherever a person is wading in flowing waters.

2. Description of Prior Art

Stealth waders are, in general, known. For example, the following patent describes a type of device that is used, primarily in still waters and for the purpose of approaching wildlife by walking in a forward direction. The device cannot be used to lessen the pressure (i.e., the force) when standing sideways (i.e., across) the flow of current.

U.S. Pat. No. 6,094,745 to Fulton, that issued Aug. 1, 2000.

While the structural arrangements of the above described device, at first appearance, may have similarities with the present invention, it differs in material respects. These differences, which will be described in more detail hereinafter, are essential for the effective use of the invention and which admit of the advantages that are not available with the prior device.

OBJECTS AND SUMMARY OF THE INVENTION

It is an object of the present invention to provide a wading device that is adapted to lessen the magnitude of the force exerted by the current upon the legs of a user.

It is also an important object of the invention to provide a wading device that is adapted to lessen the force exerted by the current when standing perpendicular with respect to the direction of current flow.

Another object of the invention is to provide a wading device that can be strapped over a leg.

Still another object of the invention is to provide a wading device that can be strapped over both legs of a user and not interfere with walking while still lessening the force exerted by the current when the user is standing perpendicular with respect to the direction of current flow.

Still yet another object of the invention is to provide a wading device that can be attached to the outside portion of each leg of a pair of waders.

Still yet another important object of the invention is to provide a wading device that is inexpensive to produce.

Still yet one further important object of the invention is to provide a wading device that lessens the amount of noise produced by the current as it passes around the legs of a user.

Briefly, a wading device that is constructed in accordance with the principles of the present invention has a generally V-shaped member that extends outward, sideways from a lower portion of a leg of a user. The device is either detachably-attachable with respect to the leg or it is attached to the outside of each leg of a pair of waders. The detachably-attachable version may be used singularly, with the V-shaped member disposed up into the current or it may be used in tandem with a second detachably-attachable version that is attached to the outside of the remaining leg, thereby reducing noise in the water.

DETAILED DESCRIPTION OF THE INVENTION

Figure 1:
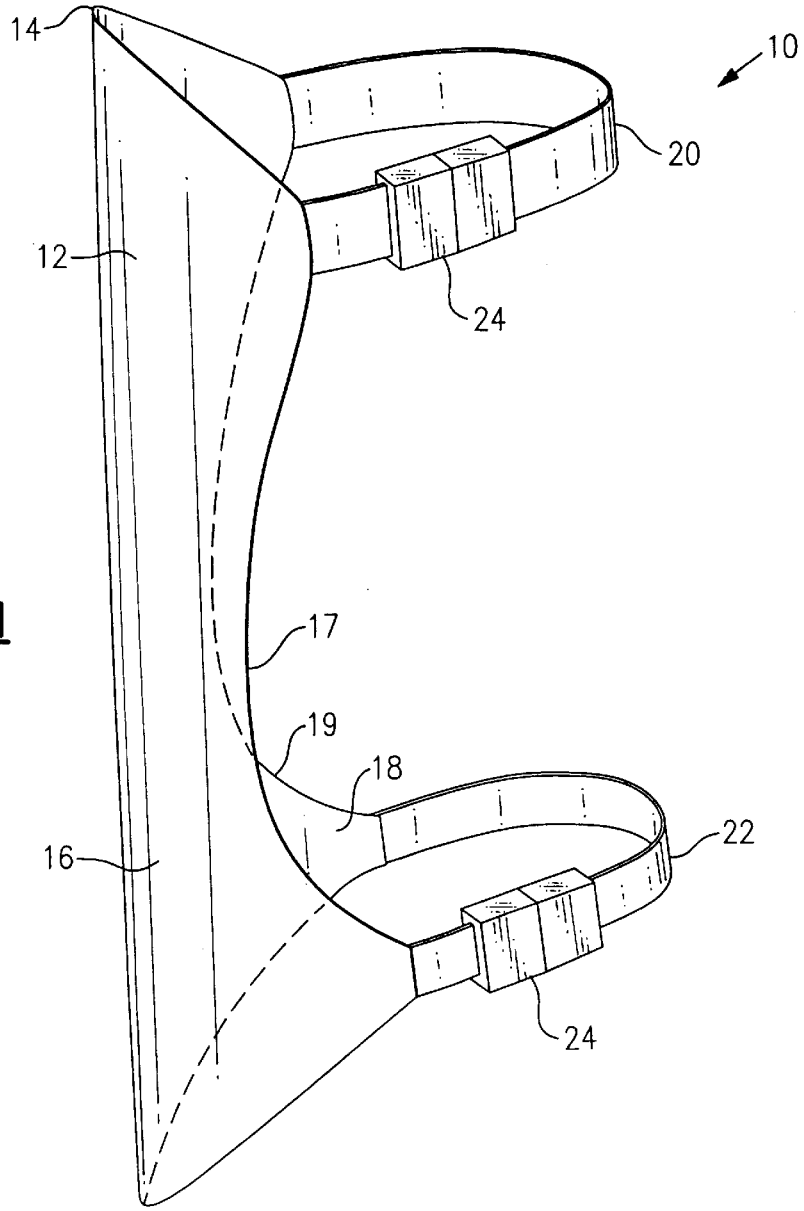
FIG. 1 is a view in perspective of a detachable version of a wading device.

Referring to all of drawings and in particular now to FIG. 1 is shown, a wading device, identified in general by the reference numeral 10.

The wading device 10 includes a generally V-shaped member 12 that is formed of any sufficiently hard material such as plastic or metal or wood or a composite.

The V-member 12 includes a pointed edge 14 on one end thereof that extends for a predetermined longitudinal distance and an opposite pair of sides 16, 18. The sides 16, 18 are formed of a substantially flat member and each side 16, 18 includes a curved end 17, 19 that is disposed furthest away from the edge 14 and which are adapted to fit snugly against the sides of a lower portion of a leg of a user (not shown).

A pair of straps 20, 22 each include a buckle 24 for adjustment.

In use the straps 20, 22 are loosened and the wading device 10 is placed over the lower portion of a leg of the user with the edge 14 extending from the side of the leg. The straps 20, 22 are then tightened by use of the buckles 24 sufficient to retain the wading device 10 in position.

According to the view of FIG. 1, the user would be facing either into the page or looking out from the page. The direction of current flow would be from left to right. The user first determines the direction the current is flowing and the direction he will be going and puts the wading device 10 on so that the V-member 12 extends into the approaching current (i.e., upstream) when he is facing directly across the river or stream.

Upon reaching the other side, the wading device 10 is removed from the leg and placed on the opposite leg in the manner described hereinabove to use on the trip back.

It is preferable, by far, to use a pair of the wading devices 10, one worn on each leg, with one V-member pointing upstream and the other member pointing downstream. This allows for easy walking across the current and back again. It also reduces the noise produced, as is described in greater detail hereinafter.

Figure 2:
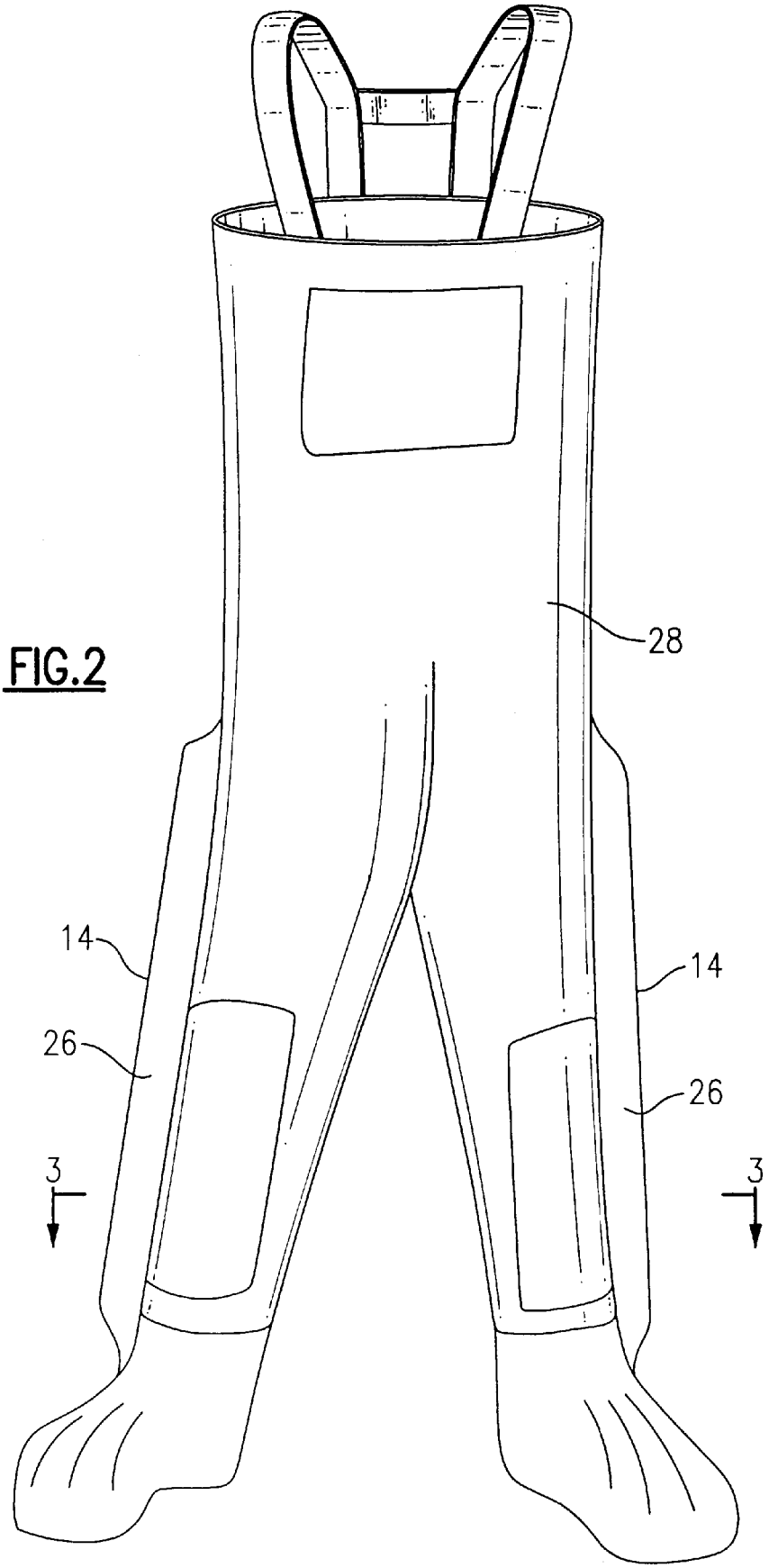
FIG. 2 is a view in perspective of a non-detachable version of a wading device attached to a pair of waders.

Referring now in particular to FIG. 2, is shown a modified pair of wading devices 26 attached to an opposite side of each leg of a pair of waders 28 and having the generally V-shaped member 12 and the pointed edge 14.

The modified wading devices 26 are made of rubber or any other flexible, yet sufficiently resilient material and are sewn or otherwise attached to each side of each leg.

In use, their positioning on the side of each leg is identical with that of the wading device 10, however the modified wading devices 26 may be made longer than the wading device 10 because the modified wading device 26 may be adapted to flex as the user walks.

As shown, the current flow may be either from the left to the right or from the right to the left. Because there is no obstruction that is presented inside of the legs, the user is able to walk normally.

The wading device 10 may be used by itself over the skin of the leg or with conventional waders that do not include the modified wading device 26 or with any type of a garment that is used to cover the leg (i.e., a wet suit).

Figure 3:
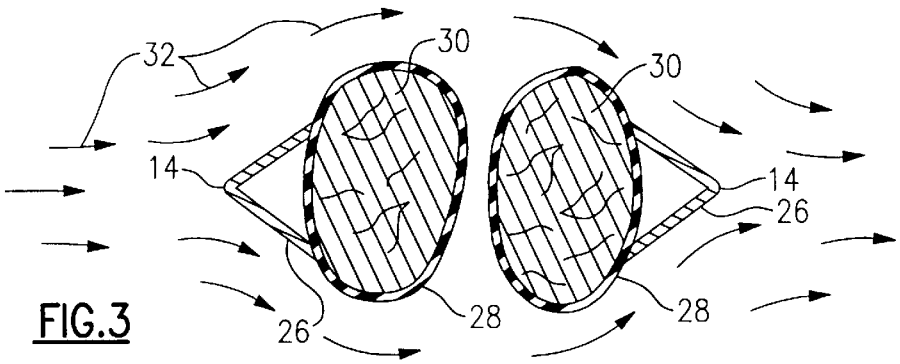
FIG. 3 is a cross sectional view taken on the line 3—3 in FIG. 2.

Referring now to FIG. 3, a cross-section of each leg 30 is shown with the leg portion of the pair of waders 28 and the modified wading devices 26 disposed on each side thereof.

The legs 30 have been moved closer together in the cross-section view of FIG. 3 than shown in FIG. 2 to better illustrate a particular and unexpected benefit that is derived from the instant invention.

A plurality of arrows 32 shows the direction taken by the current flow as it flows around the legs 30 of the user when the legs are disposed close to each other.

The current flow is naturally parted upstream and is deflected by the upstream modified wading device 26 so that it flows smoothly around the upstream leg 30.

It then continues to flow over and around the downstream leg 30 and back together as the current flow on each side of the downstream leg merges near the edge 14 of the downstream V-member 12.

Accordingly, the force of the current that is exerted upon the leg 30 is lessened while the smooth flow of water around both legs 30 lessens any noise that is produced by the moving water.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A wading device, comprising:

(a) displacing means; and (b) means adapted for attaching said displacing means to a side of a lower portion of the leg wherein said displacing means includes a V-shaped member that includes an edge that extends for a predetermined longitudinal length and wherein said edge is in substantially parallel longitudinal alignment with respect to the leg, and a pair of sides that extend from said edge at a predetermined angle with respect to each other, and wherein said edge is distally disposed with respect to the leg and wherein said V-shaped member is not adapted to face in either a forward or a rearward direction with respect to a front of the leg.

2. The wading device of claim 1 wherein each of said pair of sides includes a curved end that is adapted fit against said side of a lower portion of a leg, each of said curved ends being disposed at an end of each of said pair of sides that is disposed distally with respect to said edge.

3. The wading device of claim 1 wherein said means adapted for attaching includes means for strapping.

4. The wading device of claim 3 wherein said means for strapping includes a pair of straps, each of said pair of straps attached at one end thereof to one of said sides and attached at a remaining end thereof to another of said sides.

5. The wading device of claim 4 wherein each of said pair of straps includes a buckle, said buckle adapted for securing each of said pair of straps in position.

6. The wading device of claim 1 wherein said V-shaped member is formed of a rigid material.

7. The wading device of claim 1 wherein said V-shaped member is formed of a flexible material.

8. The wading device of claim 1 wherein said V-shaped member includes a pair of V-shaped members, each of said pair of V-shaped members being attached to a side of each leg of a pair of waders, and wherein said edge of each of said pair of V-shaped members are distally disposed with respect to each other.

* * * * *